US010506826B2

(12) United States Patent
Lynch

(10) Patent No.: US 10,506,826 B2
(45) Date of Patent: Dec. 17, 2019

(54) SLIDABLE LOCKING COLLAR CIGARETTE BOX WITH RATE AND NUMBER LIMITING FEATURES

(71) Applicant: Gregory James Sydney Lynch, Cortlandt Manor, NY (US)

(72) Inventor: Gregory James Sydney Lynch, Cortlandt Manor, NY (US)

( * ) Notice: Subject to any disclaimer, the term of this patent is extended or adjusted under 35 U.S.C. 154(b) by 0 days.

(21) Appl. No.: 16/281,504

(22) Filed: Feb. 21, 2019

(65) Prior Publication Data

US 2019/0183171 A1 Jun. 20, 2019

(51) Int. Cl.

| | |
|---|---|
| ***A24F 15/00*** | (2006.01) |
| ***B65D 85/10*** | (2006.01) |
| ***B65D 55/10*** | (2006.01) |
| ***A24F 47/00*** | (2006.01) |
| ***B65D 55/02*** | (2006.01) |

(52) U.S. Cl.

CPC ..... *A24F 15/005* (2013.01); *A24F 47/00* (2013.01); *B65D 55/026* (2013.01); *B65D 55/10* (2013.01); *B65D 85/10* (2013.01)

(58) Field of Classification Search

CPC ..... A24F 15/005; A24F 47/00; A61J 7/0445; A61J 7/0472; A61J 7/0481; B65D 85/1054; B65D 85/1036; B65D 85/1081; B65D 51/24; E05B 43/005; E05B 73/0017; E05B 73/0023; E05B 73/0058

See application file for complete search history.

(56) References Cited

U.S. PATENT DOCUMENTS

| | | | | |
|---|---|---|---|---|
| 2,613,527 | A | 10/1952 | Harris | |
| 3,854,626 | A | 12/1974 | Krechmar | |
| 4,111,638 | A * | 9/1978 | Ostberg | F23Q 2/325 431/13 |
| 4,615,681 | A | 10/1986 | Schwarz | |
| 5,203,472 | A | 4/1993 | Levenbaum et al. | |
| 5,694,919 | A | 12/1997 | Rubsamen et al. | |
| 6,125,082 | A | 9/2000 | Reid | |
| 6,401,991 | B1 | 6/2002 | Eannone | |

(Continued)

FOREIGN PATENT DOCUMENTS

FR 2950785 A1 4/2011

OTHER PUBLICATIONS

Timer Cigarette Locked Box [date accessed Oct. 5, 2018]: https://www.amazon.com/locking-cigarette-smoking-control-accessory/dp/B01IEAKOWQ.

(Continued)

*Primary Examiner* — Mollie Impink

(74) *Attorney, Agent, or Firm* — Michael J. Feigin, Esq.; Feigin and Fridman LLC

(57) ABSTRACT

A lockable cigarette box has a slidable collar which slides upwards and links to a cover of the box to hold the cover closed in an embodiment of the disclosed technology. Further, a locking mechanism within the slidable collar which attaches to a front side of the cover keeps the cigarette box closed and locked at times. One can use a dial, button, or other input to set a time and/or to run a program which allows the box to opened only up to a certain amount of times per unit of time (rate) and/or a certain total number of times over the course of the program. This allows a person to control the maximum number of cigarettes removed over a period of time and how fast the cigarettes are removed.

18 Claims, 8 Drawing Sheets

(56) References Cited

U.S. PATENT DOCUMENTS

| | | | | |
|---|---|---|---|---|
| 6,839,305 | B2 | 1/2005 | Perlman et al. | |
| 7,028,693 | B2 * | 4/2006 | Brue | A24F 15/005 131/270 |
| 2005/0146419 | A1 * | 7/2005 | Porter | A24F 15/005 340/5.73 |
| 2013/0284621 | A1 * | 10/2013 | Dincer | B65D 85/1081 206/261 |
| 2017/0202264 | A1 * | 7/2017 | Makarewicz | A24F 15/005 |

OTHER PUBLICATIONS

Design Indaba, Quit Smoking by Locking Your Cigs Away in This Smart Box [date accessed Oct. 5, 2018]: https://www.designindaba.com/articles/creative-work/quit-smoking-locking-your-cigs-away-smart-box.

* cited by examiner

SLIDABLE LOCKING COLLAR CIGARETTE BOX WITH RATE AND NUMBER LIMITING FEATURES

FIELD OF THE DISCLOSED TECHNOLOGY

The disclosed technology relates to lockable boxes, and more specifically to timed lockable boxes lockable by rate and times opened.

BACKGROUND OF THE DISCLOSED TECHNOLOGY

Quitting smoking is hard. The US Surgeon General has said, "Smoking cessation represents the single most important step that smokers can take to enhance the length and quality of their lives." It's an addiction which many have tried to break which can be helped with the aid of tools to do so. Further tools are needed to help those who have not yet quit smoking to do so or at least decrease their cigarette usage.

SUMMARY OF THE DISCLOSED TECHNOLOGY

A locking cigarette box of embodiments of the disclosed technology has a bottom and sides sized to fit a pack of cigarettes. A closing apparatus such as a cover extends over a top side and at least part of one side of the sides of the cigarette box. A slidable collar extends around the sides of the box which is adapted to hold a part of the closing apparatus perpendicular to the sides of the box and a part of the closing apparatus parallel to the sides of the box, such as along a top side of the box or creating a top side of the box. This closes the top side and sides of the cigarette box, where being "closed" is defined as lacking holes or spaces through which a single item of the contents of the box, such as cigarettes, can exit.

The locking cigarette box further has a processor coupled to a sensor, the sensor providing an indication of a locked status of the cigarette box in embodiments of the disclosed technology. The sensor or a plurality of sensors report that the cigarette box is locked when the slidable collar is in a raised position and surrounds the part of the closing apparatus which is parallel to the sides of said cigarette box. A locking bar or receptacle which connects the slidable collar to a latch of the cover can also be used to lock the box.

An input switch is configured for a user to select a maximum number of times the box is openable per period of time in embodiments of the disclosed technology. The input switch is further configured for a user to select a maximum rate the box is openable within the period of time in embodiments of the disclosed technology. A display changes based on a locking/locked status of the cigarette box in some such embodiments of the disclosed technology. This display can be on an exterior side of the box or slidable collar. The display, in some embodiments, is a first color when the cigarette box is unlocked and a second color when the cigarette box opening rate is equal to the maximum rate. When the box is locked, the display can be yet a third color. When the box is again unlocked, the color changes back to the first color. The colors can be green, yellow, and red.

The box unlocks and the color changes back from red to green after either or both of a sufficient amount of time has passed such that opening the box an additional time is at a rate less than the maximum rate and/or the maximum time for the locking of the box has elapsed. Once the maximum time has elapsed, the box remains unlocked until the locking over a period of time with a maximum number of opening times and/or rate is again set in embodiments of the disclosed technology. When locked, the slidable collar is prevented from sliding downwards to unlock the box, in embodiments of the disclosed technology, such as when the maximum number of times or said maximum rate has been exceeded.

After the input switch (including a button) is used to set a maximum number of times the box is openable per period of time, the maximum number of times the box is openable in the period of time is unchangeable until after this period of time has elapsed. That is, when the program is set, it is unchangeable until the program completes. "Unchangeable" is defined as "unable to cause to function in a different manner without inhibited future intended functionality of the device."

Described another way, a locking cigarette box of an embodiment of the disclosed technology has a box sized to fit a pack of cigarettes, a cover of the box in a closed configuration which prevents exit of a cigarette of the pack of cigarettes, a sensor used to determine when the box is opened, a memory storage device storing at least one of a rate and maximum number of times the box is openable per a period of time, and an input mechanism or device which is operable to cause storage of the rate and the maximum number of times the box is openable per period of time. A lock prevents the cover from being removed when either of the rate and the maximum number of times the cover has been removed has been exceeded.

After the maximum number of times the box is openable per the period of time is set, the box is unopenable more than the maximum number of set times until after the period of time has elapsed in embodiments of the disclosed technology. "Unopenable" is defined as "unable to be opened by way of intended mechanisms and/or without destroying or cutting into the box."

A display indicator displays a number of remaining times the box is openable during the period of time, in some embodiments of the disclosed technology. The display includes indicia which is a first color when the box is openable, and a second color when the box is unopenable due to being opened a maximum number of times within the period of time. The second or a third color can also be used when the box is unopenable at the present time because it has been opened too many times recently, such as at a rate which is at and/or higher than allowed by the prior configured settings. The second color can also be viewed as an optional or additional cigarette over user's maximum rate for the hour or yellow indicia, with the user consequence of the box locking and showing user the third color if user chooses to take the cigarette or opening while viewing second indicia. This encourages user to wait for green indicia when viewing yellow indicia, in order to maintain unlocked status. This also, gives the smoker the option to take the extra cigarette over the yellow indicia or maximum rate, like they usually would without device, but warns them with the indicia and gives them a consequence of locking for a time period when user isn't disciplined and taking the additional opening.

The cover, in embodiments of the disclosed technology, is locked by a locking collar which is movable along sides of the box and over a portion of the cover in embodiments of the disclosed technology.

Any device or step to a method described in this disclosure can comprise or consist of that which it is a part of, or the parts which make up the device or step. The term "and/or" is inclusive of the items which it joins linguistically and each item by itself. "Substantially" is defined as "at least 95% of the term being described" and any device or aspect of a device or method described herein can be read as "comprising" or "consisting" thereof.

DETAILED DESCRIPTION OF EMBODIMENTS OF THE DISCLOSED TECHNOLOGY

A lockable cigarette box has a slidable collar which slides upwards and links to a cover of the box to hold the cover closed in an embodiment of the disclosed technology. Further, a locking mechanism within the slidable collar which attaches to a front side of the cover keeps the cigarette box closed and locked at times. One can use a dial, button, or other input to set a time and/or to run a program which allows the box to open only up to a certain amount of times per unit of time (rate) and/or a certain total number of times over the course of the program. This allows a person to control the maximum number of cigarettes removed over a period of time and how fast the cigarettes are removed and smoked.

Embodiments of the disclosed technology will become more clear in view of the following description of the figures.

Figure 1:
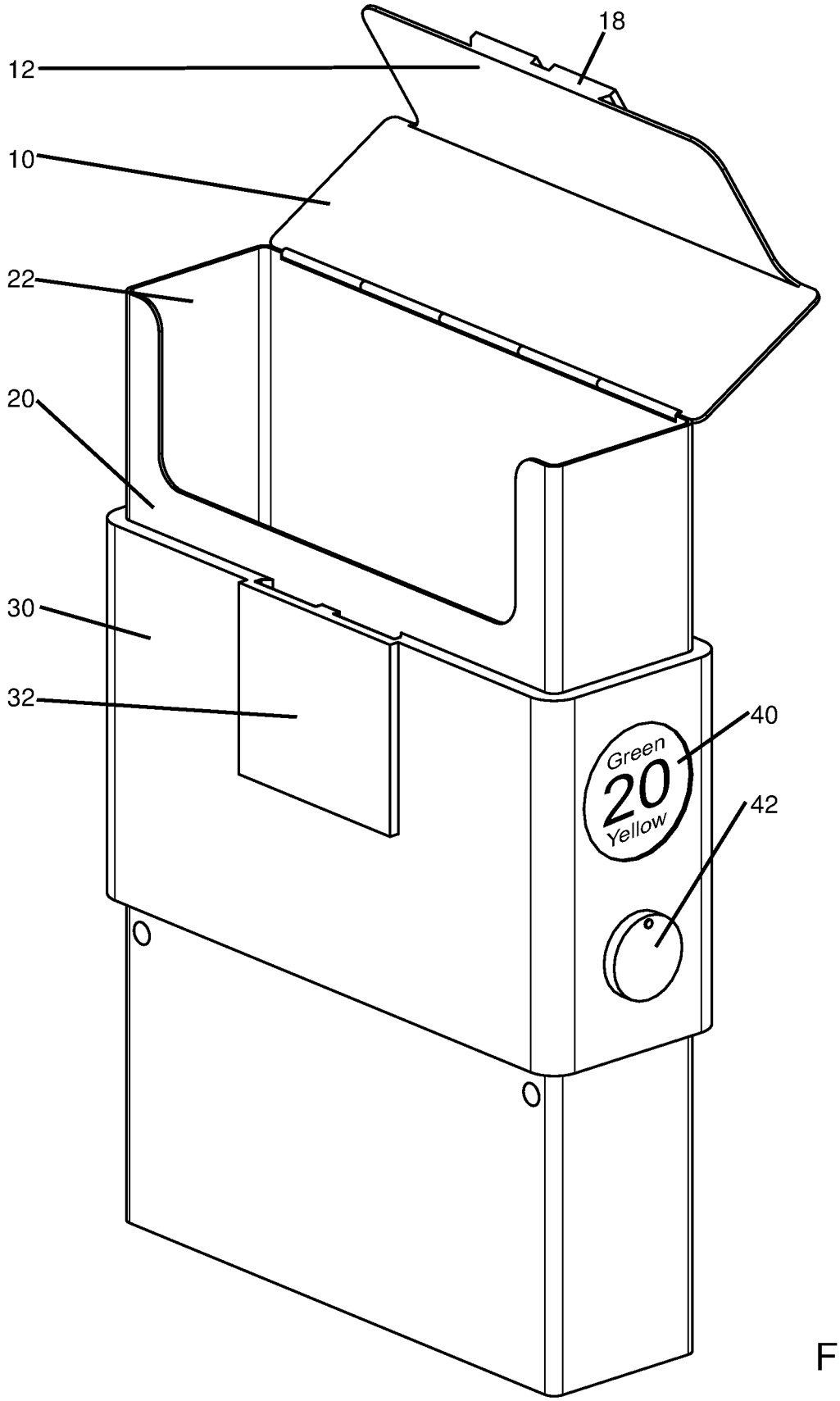
FIG. 1 shows a perspective view of an open locking cigarette box of an embodiment of the disclosed technology.

FIG. 1 shows a perspective view of an open locking cigarette box of an embodiment of the disclosed technology. The locking cigarette box shown has front and rear walls 20 joined together by side walls 22. This forms an interior space sized to fit a pack of cigarettes (where "sized to fit" is defined as having dimensions equal to or up to 10% greater in each direction than an object placed therein). This forms a substantially rectangular shape in embodiments of the disclosed technology. A top cover 10/12 closes an opening into the cigarette box having both a top section 10 and front section 12. The top section 10 is adapted to cover a top of the box whereas the front section 12 covers a part of a front side 20 and/or forms part of the front side when closed. A latching mechanism 18 fits into a latching receptacle 32 of a slidable collar 30. The slidable collar 30 surrounds the box on the front, rear, and sides and is movable vertically along the box in an unlocked condition. It should be understood that "top", "bottom", and "sides" are relative to the opening of the box with the opening shown opening to the top side and the box being permanently closed at the bottom side which is opposite the top side.

Figure 2:
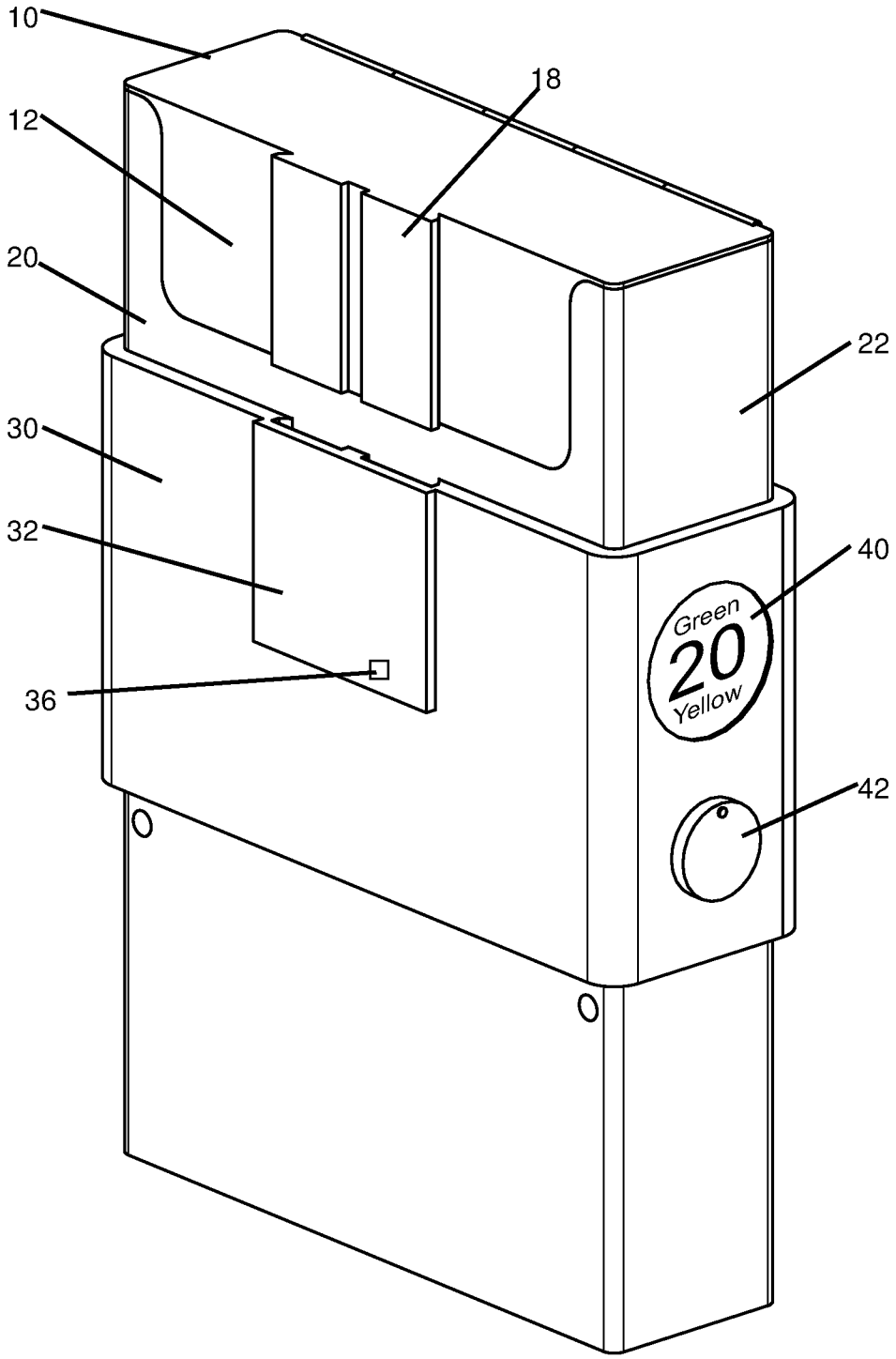
FIG. 2 shows a perspective view of a closed locking cigarette box of an embodiment of the disclosed technology.

FIG. 2 shows a perspective view of a closed locking cigarette box of an embodiment of the disclosed technology. Here, the latching mechanism 18 of the cover is aligned with a receiving connector 32 of the slidable collar 30. In this configuration, while the box is closed (all openings, if any, are smaller than a cigarette preventing exit of a cigarette or larger object) it is still unlocked as the slidable collar 30 is below the latch 18. The slidable collar 30 is slidably attached to the box at the front side 20 and sides 22. This can be based on rails or connectors thereto and/or by sliding the collar 30 over the outside edges of the box. The slidable collar 30 can be lifted until the latching receptacle 32 is latched to the latching mechanism 18. It should be understood that any connector known in the art can be used to lock the slidable collar over the cover 12 and keep the device closed and/or in a locked condition. Note that a sensor 36 within the latching receptacle 32 can be used to determine that the box is closed and then a latch or pin can be moved into position to lock the cover 12 closed.

Figure 3:
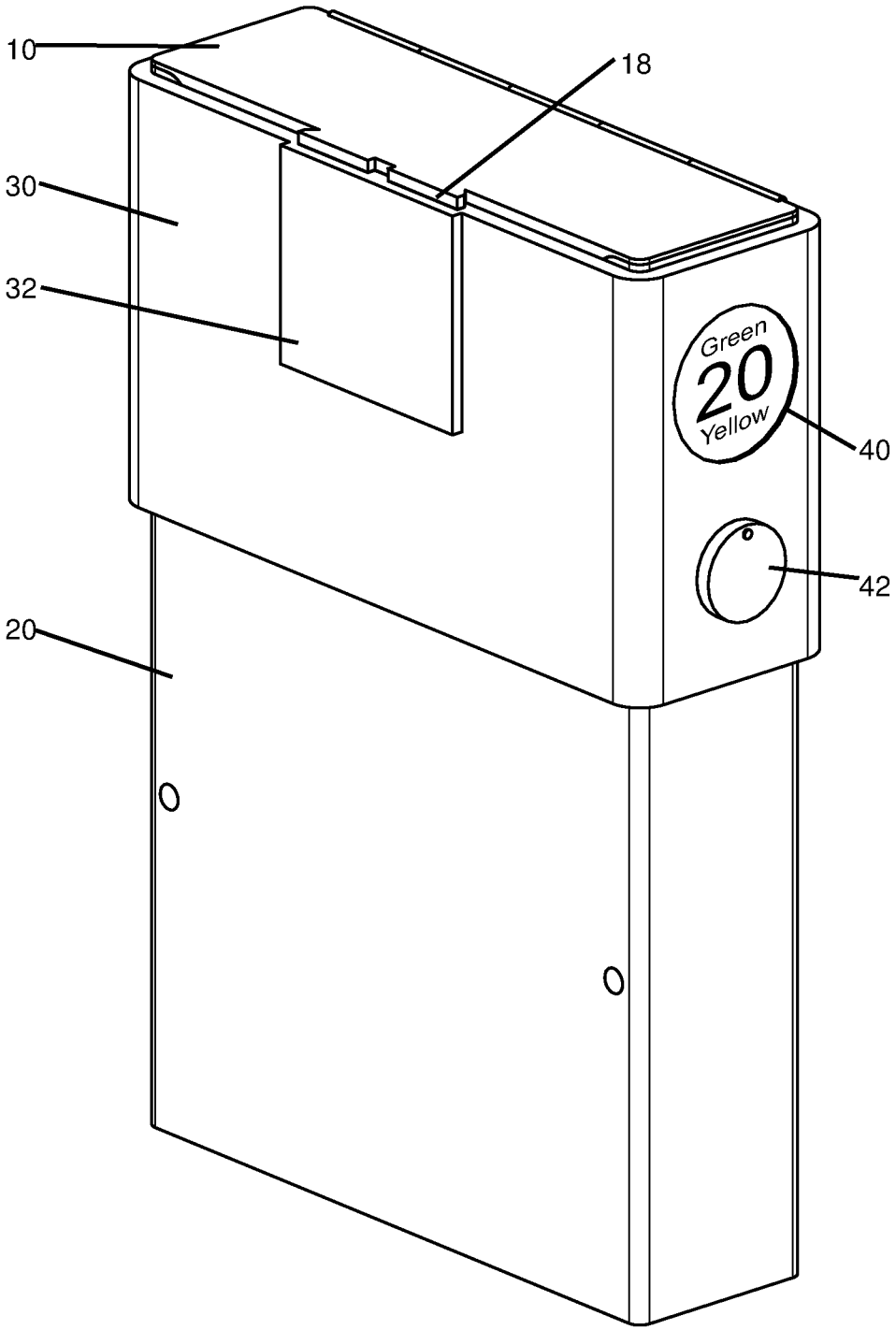
FIG. 3 shows a perspective view of a closed locking cigarette box with a raised slidable collar of an embodiment of the disclosed technology.
Figure 4:
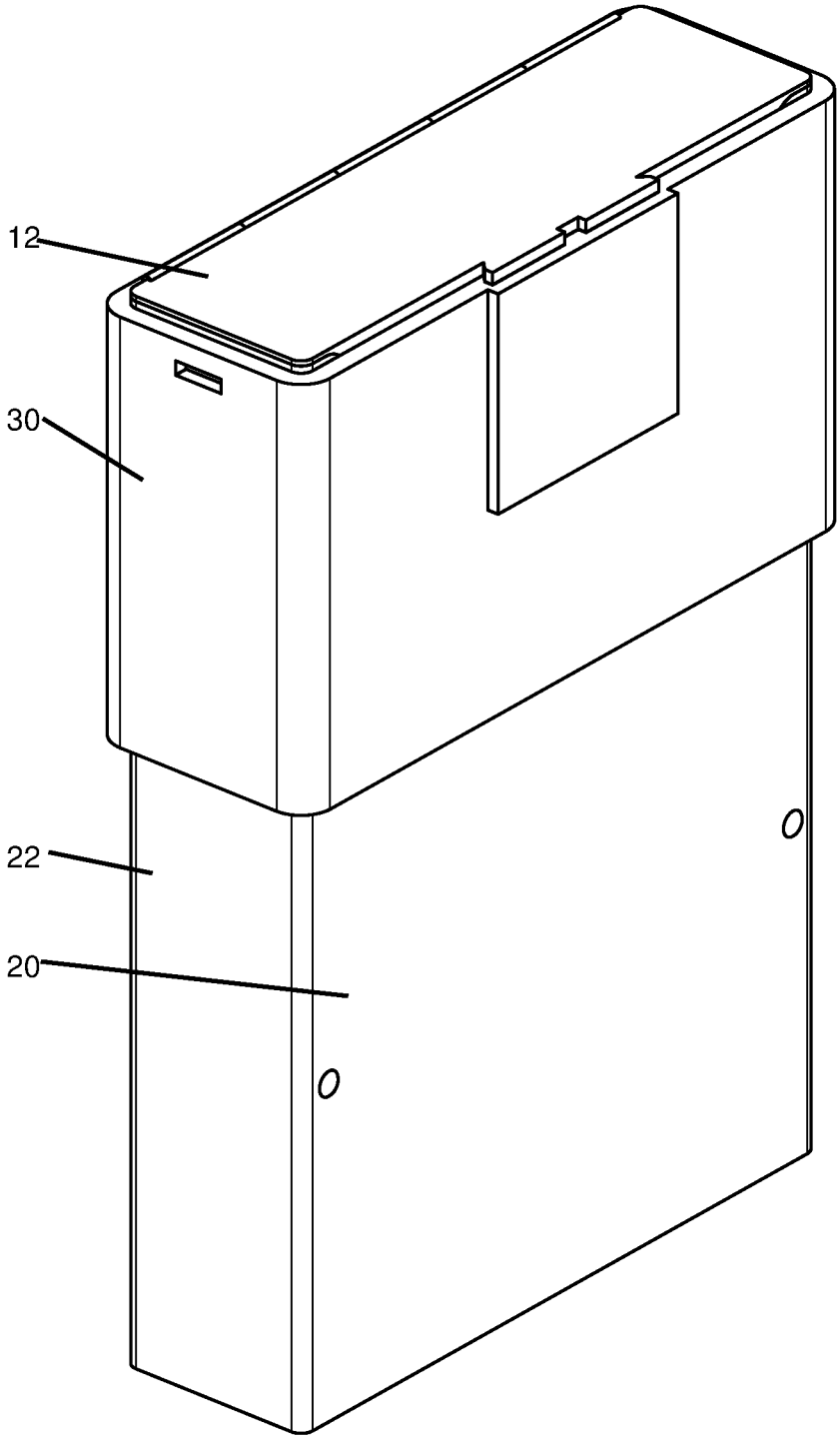
FIG. 4 shows a reverse perspective view of a closed locking cigarette box with a raised slidable collar of an embodiment of the disclosed technology.

FIG. 3 shows a perspective view of a closed locking cigarette box with a raised slidable collar of an embodiment of the disclosed technology. FIG. 4 shows a reverse perspective view of a closed locking cigarette box with a raised slidable collar of an embodiment of the disclosed technology. Here, the slidable collar 30 has been raised so that the latching mechanism 18 is hooked into the latching receptacle 32 and can be locked in place.

Figure 5:
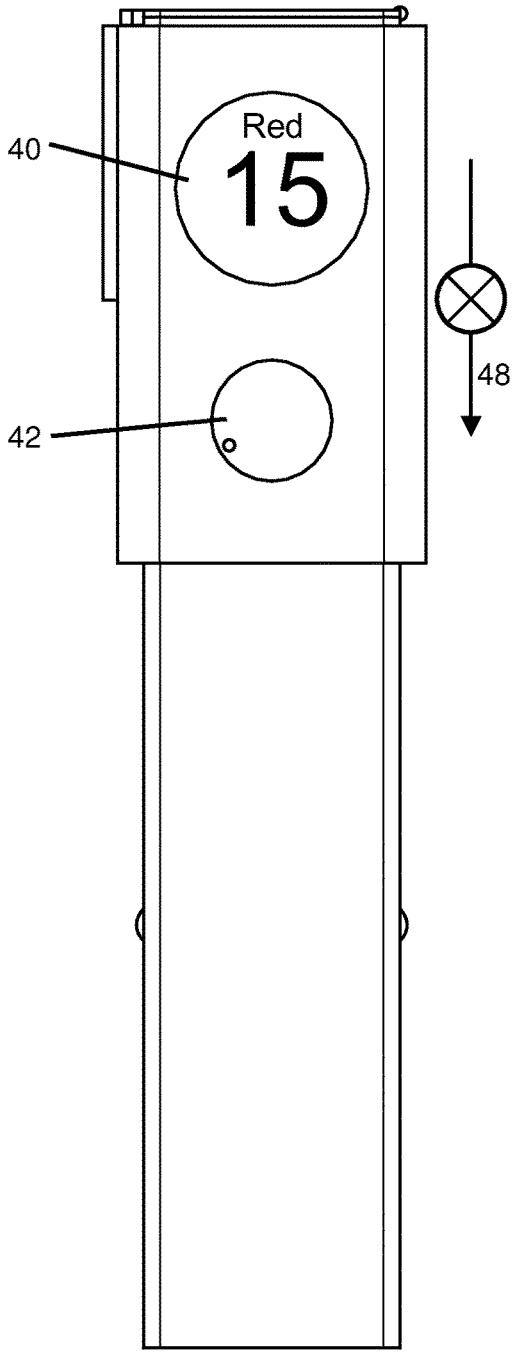
FIG. 5 shows a side elevation view of a locked locking cigarette box of an embodiment of the disclosed technology.
Figure 6:
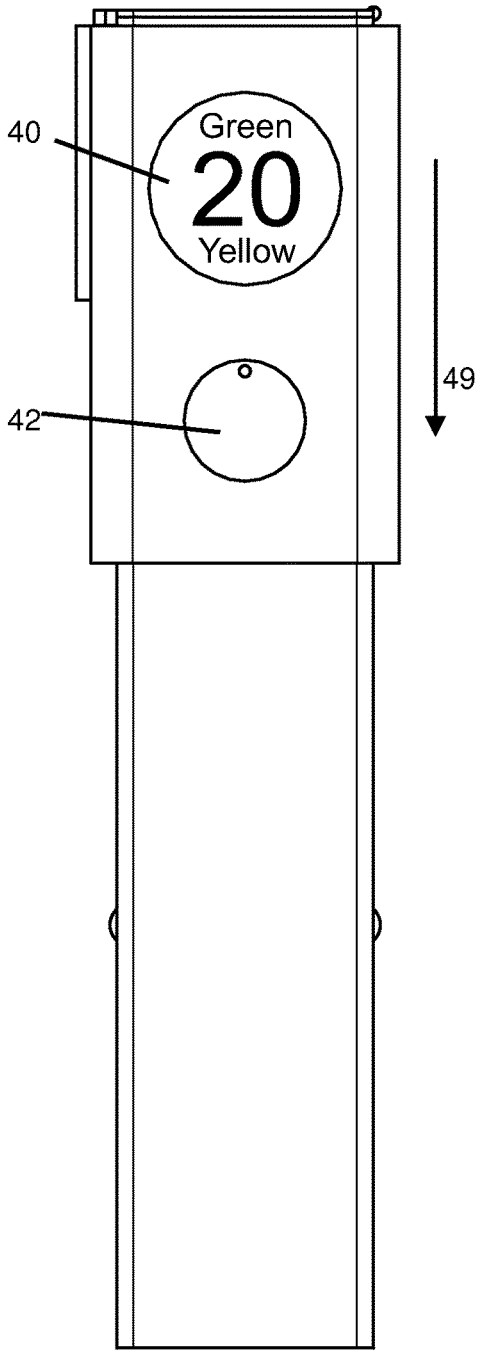
FIG. 6 shows a side elevation view of an unlocked locking cigarette box of an embodiment of the disclosed technology.

FIG. 5 shows a side elevation view of a locked locking cigarette box of an embodiment of the disclosed technology. FIG. 6 shows a side elevation view of an unlocked locking cigarette box of an embodiment of the disclosed technology. A display 40 can show one or both of a number of times the locking cigarette box can be opened during a specific time period and if the box can be opened at the present time. This is set using a button 42 or other input mechanism or switch. The button 42 can be a dial, a depressible dial, a series of such dials or buttons, or input from a wireless transceiver or wire where it is programmed by way of encoded instructions executed on a computing device such as shown in FIG. 9. When the device is in a "locked" condition, it remains locked until a pre-defined period of time passes as will be described in more detail with respect to FIG. 8. Thus, in a locked condition, when for example a maximum number of openings of the lockable cigarette box have occurred in a subset of a unit of time being tracked, the display is in red and downward movement of the collar is prevented, as represented by arrow 48. On the other hand, when the box can be opened, then the display may be green or yellow as shown in FIG. 6, and the collar can be moved downwards to open the box as represented by arrow 49.

In embodiments of the disclosed technology, the button 42 (or other input) is used to set both a rate at which the box can be opened (such as 1, 2, or 3 times per hour), a maximum number of times the box can be opened (such as 10 or 20 times) and a time frame over which the previous two variables are operable (such as over a 20 or 24 hour period of time). When the box has been opened at a rate equal to the maximum rate, the indicia on the display 40 can change from "green" to "yellow" as a warning. When opened faster than this, the indicia can change from "yellow" to "red" indicating that the box is locked and locking the box until enough time has passed to return to the "yellow" or "green" (unlocked condition). The number shown in large font, e.g. the "15" in FIG. 5 and the "20" in FIG. 6 can refer to the number of times the box can still be opened during the time period. That is, the box can be opened 15 more times over, for example, a 20 hour period which has already begun.

Figure 7:
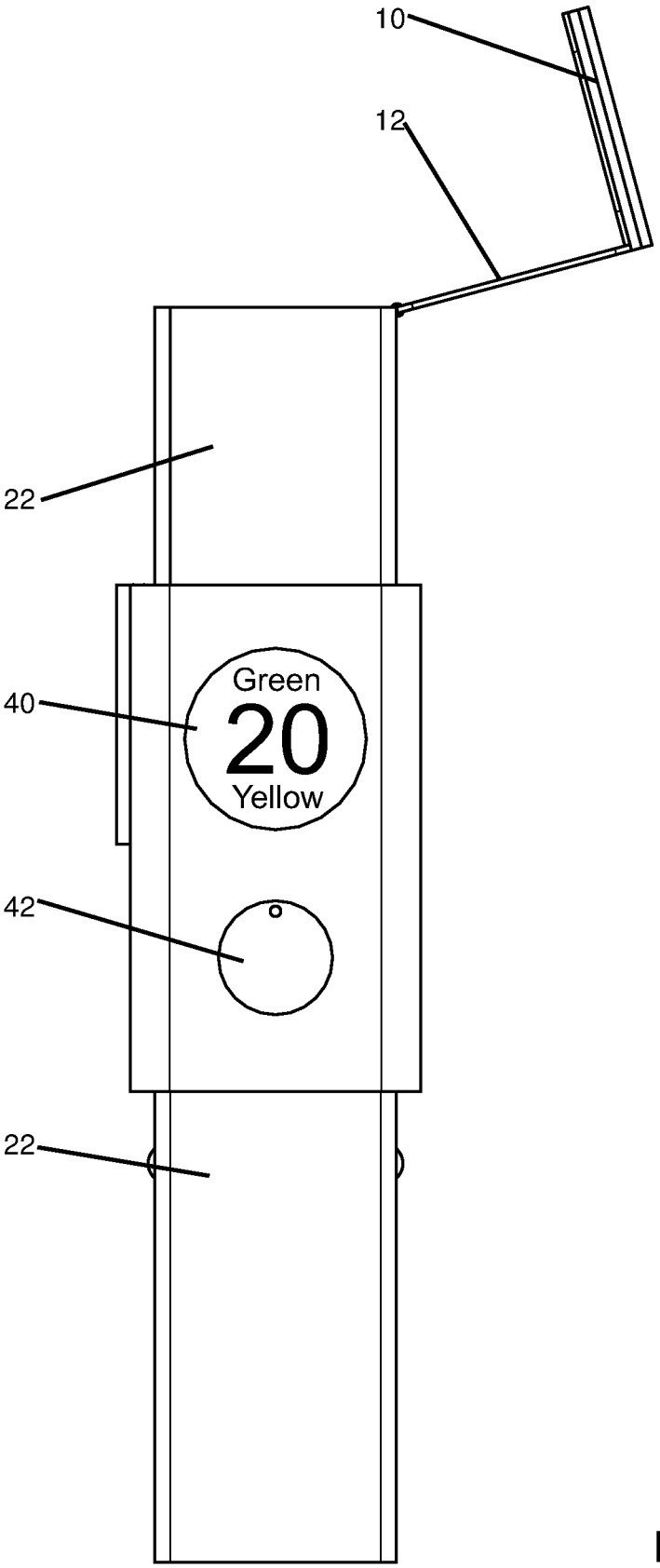
FIG. 7 shows a side elevation view of an open locking cigarette box of an embodiment of the disclosed technology.

FIG. 7 shows a side elevation view of an open locking cigarette box of an embodiment of the disclosed technology. Here, the box is opened and cigarettes or other contents can be removed by way of the open top side as the cover 12 is outside a plane of the rest of the box 20/22.

Figure 8:
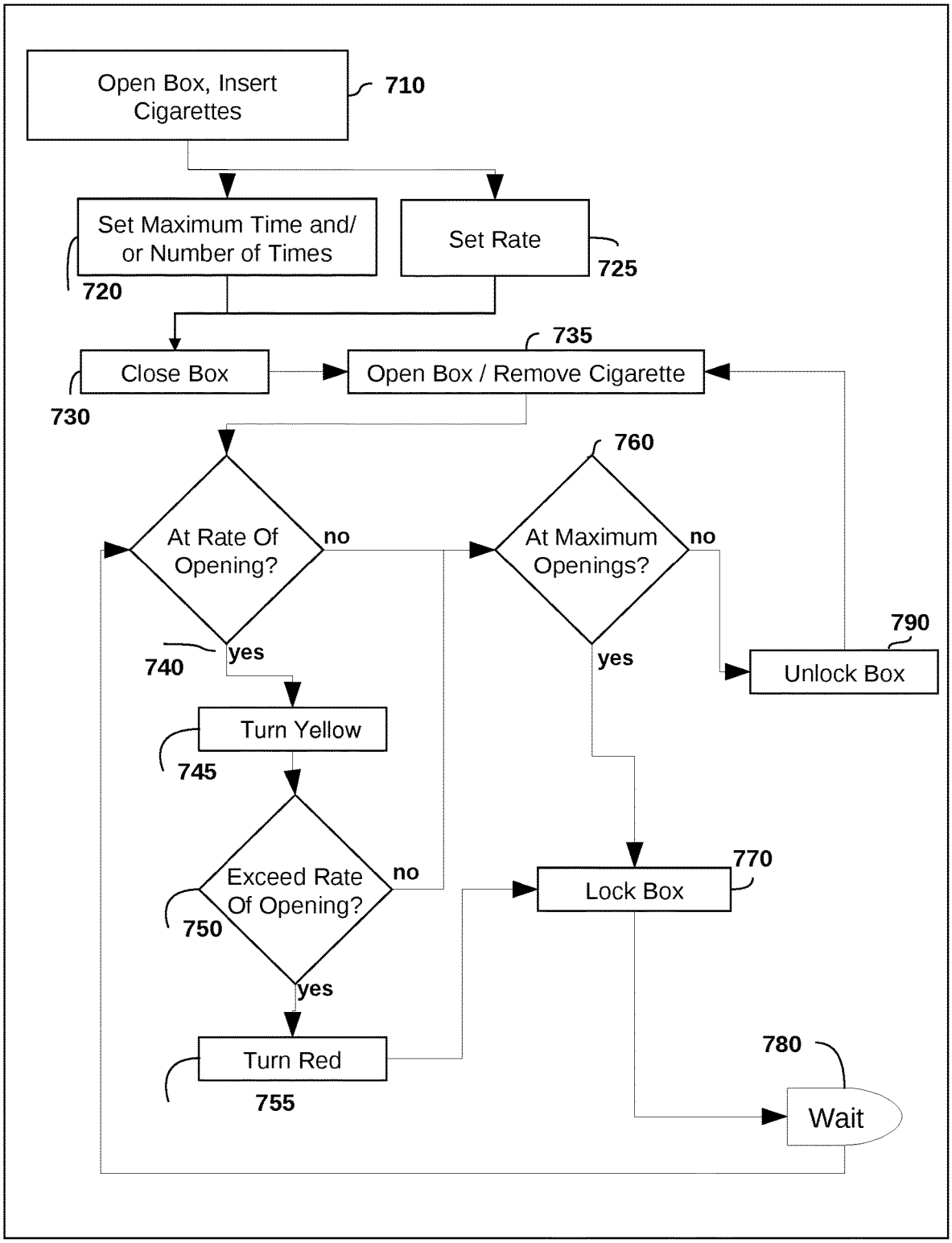
FIG. 8 shows a flow chart of method of using the locking cigarette box of embodiments of the disclosed technology.
Figure 9:
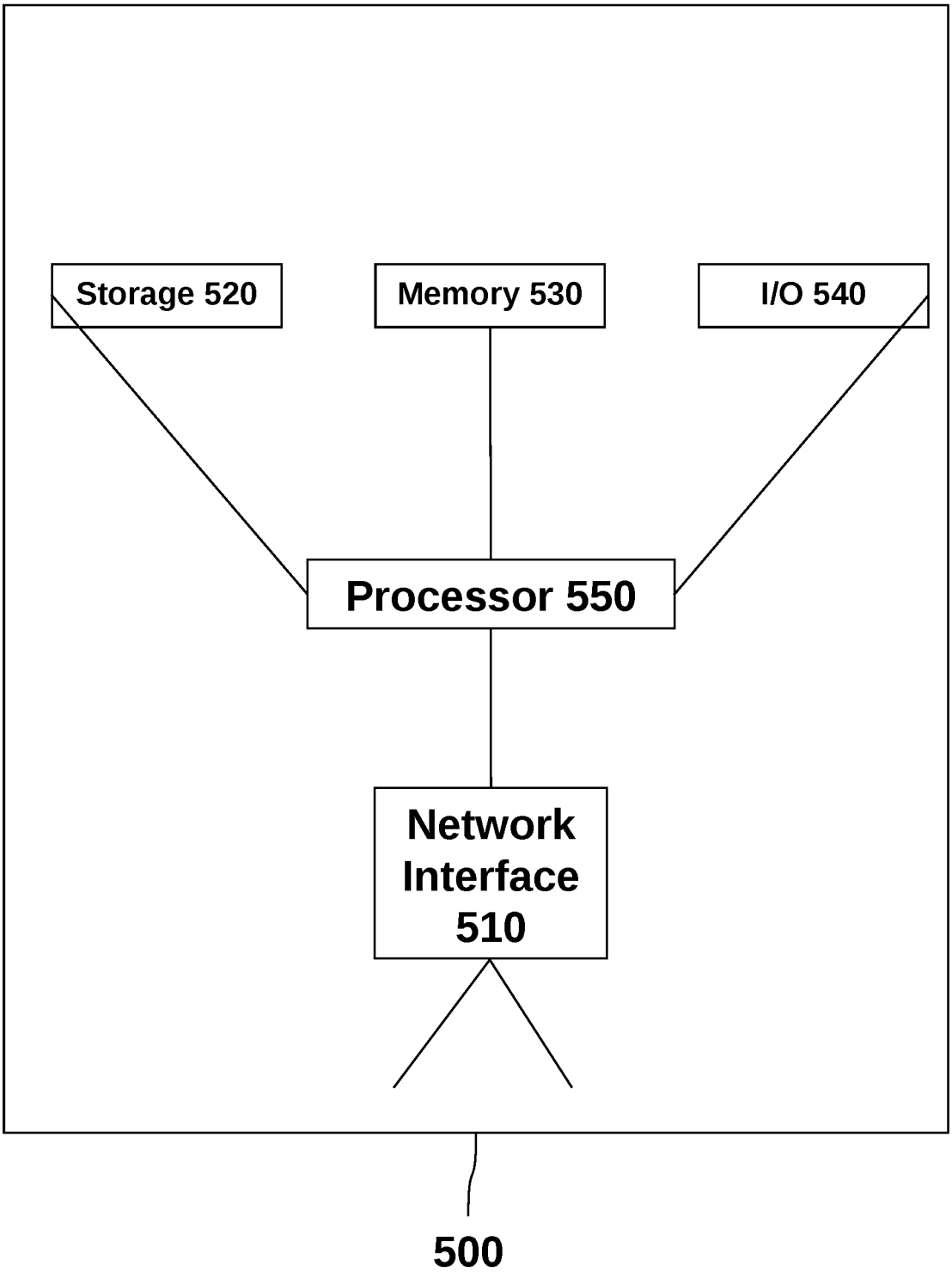
FIG. 9 shows a high level block diagram of devices used in connection with embodiments of the disclosed technology.

FIG. 8 shows a flow chart of method of using the locking cigarette box of embodiments of the disclosed technology. In step 710 the box is opened and cigarettes are placed therein. It should be understood that any object can be placed in the box including medicine, toys, or birth control. Using, for example, the dial 42 as shown in the prior figures, one can set, in step 720, the maximum time frame for a program to run. For example, a program can run for 20 hours. During this time it can also be set that a certain maximum number of times one can open the box. For example, one may be able to open the box 20 times maximum representing an average rate of once per hour. Thus, in step 725 one can set the maximum rate such as 1 or 2 openings per hour maximum. One may also set a changing rate made up of a higher and lower rate such that a user sets a higher rate (e.g. 2 openings per hour) for a maximum number of hours (e.g. 4 times) so that any time during the program completed by the user successfully, the rate is lowered (e.g. by 1 per hour) during the next iteration thereof. Once this is set or before the settings in step 720 and 725, the box is closed in step 730. The settings for how long a program runs and how often the box can be opened can also be part of a predefined setting which is selected or automatically is chosen as a default when a user carries out the rest of the method steps listed below starting at step 735.

The box is now ready for use and during the length of the program (in this example, 20 hours) one can open the box a maximum of 20 times and no more than twice per hour, by way of example. One then opens the box removing a single cigarette each time the box is opened in step 735. Step 735, opening the box, can be tried at any time by a user thereof, but the box will be unlocked and able to be opened only if conditions in steps 740 through 790 are properly met. Each time the box is opened, the opening is counted against both the maximum number of times the box can be opened and rate at which the box can be opened and stored into memory. This step is implicit in the carrying out of the steps shown in FIG. 8.

Further, each time the box is opened, a sensor detects this opening thereof and then steps 740 through 790 are carried out. First, in step 740, it is determined if the opening is equal to the rate of opening allowed. For example, if the maximum rate of opening is 2 per hour and this is the second opening within the hour, this is determined in step 740. If the box has been opened at the maximum rate an indicia or display on the box or separate from the box changes to inform the user/caution the user thereof that they are at their maximum. Thus, for example, in step 745 the indicia turns yellow as a warning that the box cannot be opened further at this time or one more opening will cause the box to lock until sufficient time passes for the rate to be under the maximum set in step 725. If, in the same or a separate iteration of step 740 triggered by the opening of the box in step 735 in this or another separate iteration, the rate of opening the box has exceeded the rate set in step 735 the indicia displays information communicating same (such as turning red in step 755) and the box is locked in step 770. If the rate of opening has not been exceeded in step 740, it is still possible that the maximum number of openings has been exceeded in step 760. For example, where the time of the program is 20 hours and the rate is set at no more than two openings per hour, it is possible that after 10 hours the number of openings will be at a maximum. Once the box has been opened a maximum number of times, the box is locked in step 770. Once the box is locked in step 770 the method enters a loop waiting until both the rate of opening (step 740) and maximum opening (760) are below the respective threshold maximums set in step 725 and 720. This can be described as waiting in step 780 for this to occur as the passage of time allows for a decrease in the rate or the end of the maximum time set in step 720. This can further be described as looping from step 770 to step 740 in a continuous cycle. Once the rate has decreased such that the box can be opened again, step 740 is answered in the negative causing decision block 760 to be carried out. If openings are still left in the time of the program (as set in step 720) then the box is unlocked in step 70. Alternatively, if the maximum amount of time has passed, that is, for example, if the box was to be selectively unlocked over a period of 20 hours which have passed, the box is now unlocked. Once the box is unlocked, step 735 is ready to be carried out where the user opens the box and removes another cigarette.

Further, after the elapsed time set in 720 has passed the box is in a permanently unlocked condition subject to a user setting a new program with a time for carrying out selective unlocking again with a maximum quantity of openings of the box and/or maximum rate. That is, one can use the same locking cigarette box and again begin at step 710, 720, or 725.

The display on the device, in embodiments of the disclosed technology, has a color coded, lettered, or other differentiating indicia to evaluate the cigarette removal (box opening) rate. When the maximum opening rate per time period and per day is below the maximum threshold allowed (e.g. user didn't open box when display was "yellow") then a top grade (e.g. "A") is shown. In a method of use, the user then, the next day or time period, decreases the total amount of box openings and/or rate of opening allowed to help lower their cigarette intake. When the user exceeds their threshold allowance or maximum rate of box openings (e.g. a "yellow" display was shown and user opened box and "red" display followed upon user closing box, indicating box was locked) in the previous time period they receive a second to top grade (e.g. "B") which is shown. If the afore-described event happened at least two times during the previous time period (e.g. a "red" twice) then the third grade is received (e.g. "C").

In some embodiments, a time period, such as a 10 second period, where the box must be closed after each opening during the active cycle is set. If the box is kept open too long, an alarm will sound or the box will lock longer once closed in order to encourage a user to close the box right away and take only one cigarette at a time. Or, the user's grade (described in the preceding paragraph) may be lowered or otherwise be given a negative or positive indicator (e.g. a "+" or "−") based on how quickly the box is closed after each opening.

FIG. 9 shows a high level block diagram of devices used in connection with embodiments of the disclosed technology. Device 500 comprises a processor 550 that controls the overall operation of the computer by executing the device's program instructions which define such operation. The device's program instructions may be stored in a storage device 520 (e.g., magnetic disk, database) and loaded into memory 530 when execution of the console's program instructions is desired. Thus, the device's operation will be defined by the device's program instructions stored in memory 530 and/or storage 520, and the console will be controlled by processor 550 executing the console's program instructions. A device 500 also includes one or a plurality of input network interfaces for communicating with other devices via a network (e.g., the internet). The device 500 further includes an electrical input interface. A device 500 also includes one or more output network interfaces 510 for communicating with other devices. Device 500 also includes input/output 540 representing devices which allow for user interaction with a computer (e.g., display, keyboard, mouse, speakers, buttons, etc.). One skilled in the art will recognize that an implementation of an actual device will contain other components as well, and that FIG. 4 is a high level representation of some of the components of such a device for illustrative purposes. It should also be understood by one skilled in the art that the method and devices depicted in FIGS. 1 through 3 may be implemented on a device such as is shown in FIG. 4.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A locking cigarette box, comprising:

a front wall and a rear wall joined together by a pair of sidewalls defining a closed bottom side and an open top providing access to an interior space sized to fit a pack of cigarettes;

a cover hingedly connected to a perimeter of the open top, the cover including a top section that covers the open top of the box and a front section that covers a front side of the box when the cover is in a closed position;

a collar slidably disposed around the box, the collar vertically slidable along the box; and a latching mechanism including a latch disposed on the front section of the cover and a latch receptacle disposed on the collar, the latching mechanism including a locked configuration and an unlocked configuration;

wherein:

in the locked configuration the collar is slid over the cover while the cover is in the closed position and the latch is attached in the latch receptacle, thereby locking the collar around the cover and the cover over the open top; and in the unlocked configuration the latch is not attached in the latch receptacle, thereby allowing the cover to open and close about the open top and the collar to slide vertically along the box.

2. The locking cigarette box of claim 1, wherein said locking cigarette box further comprises a processor coupled to a sensor, said sensor providing an indication of a locked status of said cigarette box.

3. The locking cigarette box of claim 2, wherein said sensor or a plurality of sensors report that said cigarette box is locked when said collar is in a raised position and surrounds a part of said latching mechanism which is parallel to said front wall, said rear wall, and said pair of sidewalls of said cigarette box.

4. The locking cigarette box of claim 2, further comprising an input switch configured for a user to select a maximum number of times said box is openable per period of time.

5. The locking cigarette box of claim 4, wherein said input switch is further configured for a user to select a maximum rate said box is openable within said period of time.

6. The locking cigarette box of claim 5, further comprising a display which changes based on a said locked status of said cigarette box.

7. The locking cigarette box of claim 6, wherein said display is a first color when said cigarette box is unlocked and a second color when said cigarette box opening rate is equal to said maximum rate.

8. The locking cigarette box of claim 1, wherein:

the front wall includes a recess for receiving the front section of the cover to close the open top of the box.

9. The locking cigarette box of claim 8, wherein the cover is hingedly connected to an edge of the rear wall.

10. The locking cigarette box of claim 8, wherein the latch and the latch receptacle are aligned along a longitudinal axis of the box.

11. The locking cigarette box of claim 8, further comprising a sensor coupled to the latching mechanism, wherein the sensor detects that the box is in the closed position.

12. The locking cigarette box of claim 11, wherein the sensor is disposed within the latching receptacle.

13. The locking cigarette box of claim 8, further comprising:

an input for inputting a maximum rate at which the box can be opened, a maximum number of times the box can be opened, and a specific time frame under which the maximum rate at which the box can be opened is operable and the maximum number of times the box can be opened is operable to form a programmed rate;

a display for displaying the maximum number of times the box can be opened, the remaining number of times that the box can be opened, or whether the box can be opened at the present time;

a memory for storing the programmed rate; and a processor for executing the programmed rate;

wherein:

the processor causes the display to display the maximum number of times the box can be opened, the remaining number of times that the box can be opened, or whether the box can be opened at the present time in response to the box being opened;

the processor causes the latching mechanism to lock in the locked configuration if the maximum number of times the box can be opened has been reached; and the processor causes the latching mechanism to unlock in the unlocked configuration after the specific time frame has lapsed.

14. The locking cigarette box of claim 13, further comprising a sensor coupled to the processor, wherein:

the sensor detects that the box is in the closed position;

the sensor provides an indication that the cover is in the closed position; and the processor causes the latching mechanism to lock in the locked configuration.

15. The locking cigarette box of claim 14, wherein the sensor is disposed within the latching receptacle.

16. The locking cigarette box of claim 13, wherein the input comprises a dial.

17. The locking cigarette box of claim 13, wherein:

the display displays a first color when the box has been opened less than the maximum number of times the box can be opened over the specific time frame; and the display displays a second color when the maximum number of times the box can be opened over the specific time frame has been reached.

18. The locking cigarette box of claim 17, wherein the display displays a third color when the maximum rate at which the box can be opened has been exceeded.

* * * * *